United States Patent [19]

Camin

[11] 3,983,350

[45] Sept. 28, 1976

[54] LIQUID CONTACT SWITCH ASSEMBLY INCORPORATED WITHIN WRIST WATCH CASING

[75] Inventor: Michel G. Camin, Cortaillod, Switzerland

[73] Assignee: Henri Gunzinger-Gunzinger, Welschenrohr, Switzerland

[22] Filed: Apr. 14, 1975

[21] Appl. No.: 568,115

[30] Foreign Application Priority Data

Dec. 20, 1974 Switzerland ..... 17153/74

[52] U.S. Cl. ..... 200/61.47; 58/50 R; 200/52 R; 200/220; 200/226; 200/228; 58/88 R

[51] Int. Cl.[2] ..... G04B 37/00; H01H 29/04; H01H 29/20

[58] Field of Search ..... 58/50 R, 88 R, 1 R; 200/61.47, 184, 188, 189, 190, 214, 220, 221–228, 232

[56] References Cited

UNITED STATES PATENTS

| | | | |
|---|---|---|---|
| 1,676,754 | 7/1928 | Walker | 200/228 |
| 1,871,177 | 8/1932 | Held | 200/188 |
| 1,941,971 | 1/1934 | Callahan | 200/228 X |
| 1,974,411 | 9/1934 | Cole | 200/228 X |
| 2,229,990 | 1/1941 | Sateren | 200/227 |
| 2,311,808 | 2/1943 | Bacon | 200/227 X |
| 3,855,784 | 12/1974 | Foellner | 58/50 R |

*Primary Examiner*—James R. Scott
*Attorney, Agent, or Firm*—Pollock, VandeSande & Priddy

[57] ABSTRACT

An electric switch for a wrist-watch equipped with electric or electronic circuitry requiring a on/off switching at will. An enclosure assembly defines an enclosed chamber wherein an electrically conductive liquid can move responsive to different positions given to the watch. Two electrically conducting parts, structurally isolated from one another, are exposed inside and outside the enclosed chamber. The conductive liquid establishes an electrical connection between these two parts only when it is in a predetermined location within the enclosed chamber, which occurs only when the watch is held in a predetermined vertical or slanting position. The enclosed space is annular and is provided with baffle elements for preventing the liquid from reaching the aforementioned location by simple inertia when the watch is subject to shaking, shocks, or acceleration.

Such an electric switch is suitable for controlling the illumination of the display of the watch.

12 Claims, 9 Drawing Figures

LIQUID CONTACT SWITCH ASSEMBLY INCORPORATED WITHIN WRIST WATCH CASING

Figure 1:
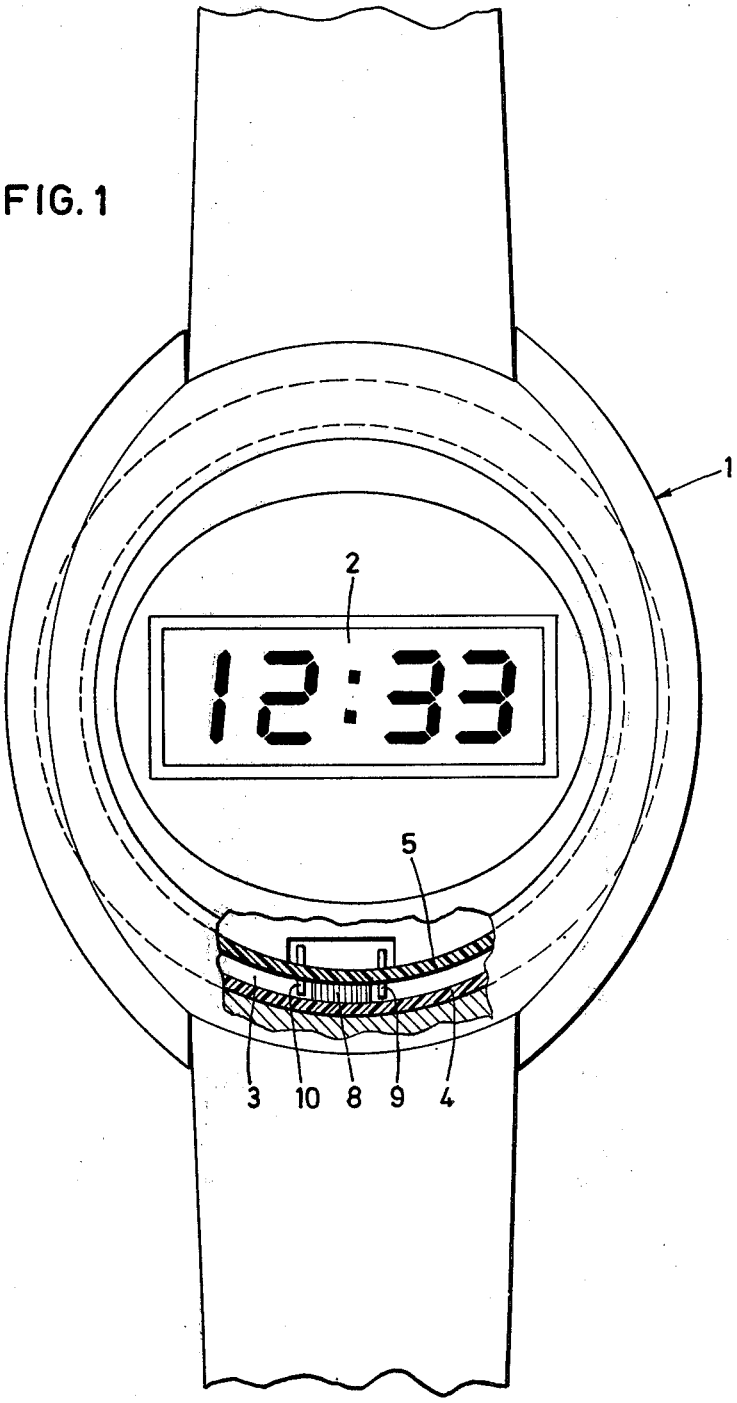

This invention relates to an electric switch device for wrist-watches equipped with electric or electronic circuitry, comprising an enclosure assembly having at least one component adapted to be secured in such a wrist-watch, the assembly defining an enclosed space of a predetermined configuration and volume, and an electrically conductive liquid confined within the enclosed space and having a volume less than the predetermined volume of the enclosed space, the assembly comprising at least one electrically insulating part and two electrically conductive parts, the electrically conductive parts being structurally isolated from one another and each being exposed outside the enclosed space for connection to the electric or electronic circuitry of the watch, and inside the enclosed space for being selectively either electrically connected to one another via the conductive liquid or left electrically separated from one another in response to movements of the conductive liquid within the enclosed space depending upon various positions assumed by the assembly.

Devices of this kind have already been proposed and are used in wrist-watches to control, for example, the illumination of an electronic display only when the watch is in a certain position, called the observation or read-off position, with a view to saving on the power supplied by the battery of the watch by dispensing with the illumination when it is not needed. However, the known devices of this kind, when used to switch on the illumination by closing a contact, usually a mercury contact, have the drawback of reacting not only in response to positioning in the read-off position, i.e., at an angle of 45° to the horizontal "9 o'clock – 3 o'clock" axis (actuation by gravity), but also in response to shocks or jolts (actuation by inertia) which may occur while the watch is being worn, e.g., when the wearer walks or gestures without having any intention at all of looking at his watch to tell the time. It has been found that during the course of a day, such "random" operation caused by inertia accounts for a significant amount of superfluous power consumption which may be as much as or even more than that associated with "useful" illumination of the display.

It is the object of this invention to provide a device of the aforementioned kind which makes it possible in particular to eliminate the drawback described above, which is also simple to construct, and which may be accommodated in a watch without increasing the size of the watch.

To this end, in the electric switch device according to the present invention, at least one of the conductive parts comprises a portion made of electrically conductive material accommodated in the insulating part and exposed within the enclosed space only at a predetermined location thereof where it is delimited by a curved surface, and the switch device further comprises at least one baffle element disposed in the enclosed space in proximity to the aforementioned predetermined location for preventing the conductive liquid from coming in contact by simple inertia with the portion made of electrically conductive material when the assembly is subjected to jolts.

In a preferred embodiment of the invention which can be produced simply and inexpensively in a form which takes up practically no space in the watch, the enclosure assembly defines an annular enclosed chamber or space which is preferably formed by the joining of two annular parts made of insulating material. The electrically conductive liquid confined in the enclosed space is preferably mercury.

Figure 2:
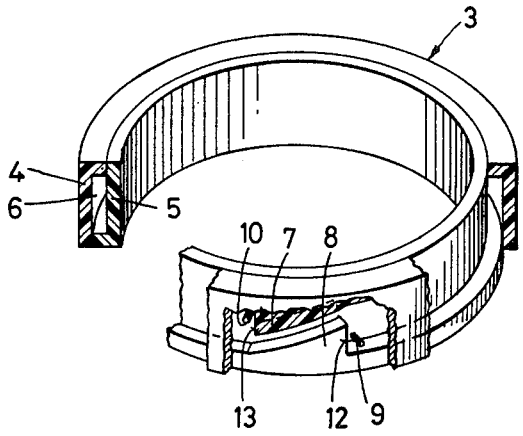
Figure 3:
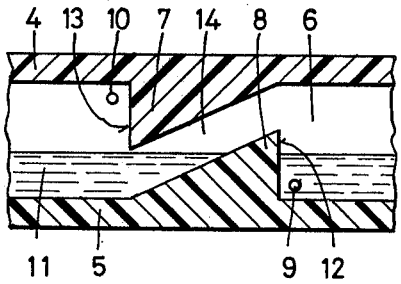
Figure 5:
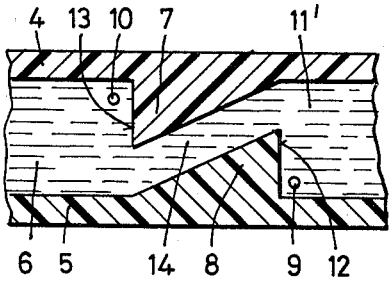
Figure 4:
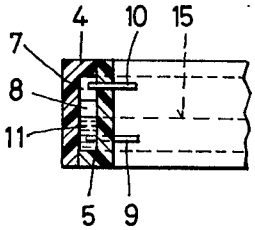
Figure 6:
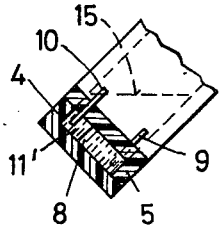
Figure 7:
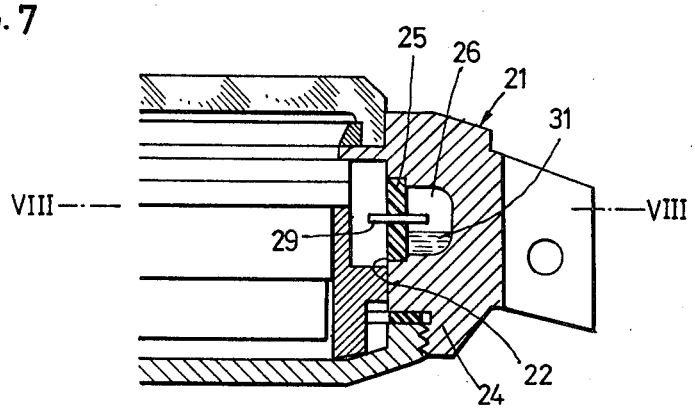
Figure 8:
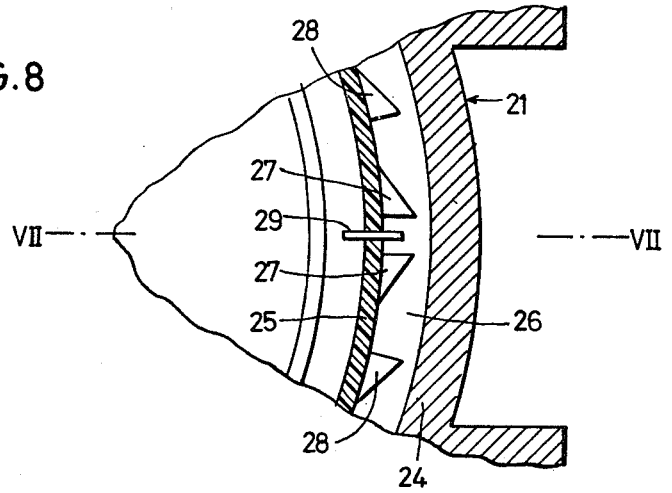
Figure 9:
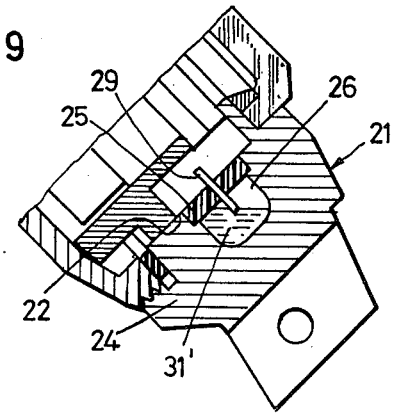

Other objects and advantages of the invention will become apparent from the following detailed description of a preferred embodiment thereof, taken in conjunction with the accompanying drawings, in which:

FIG. 1 is a top plan view of an electronic digital-display wrist-watch equipped with a position-sensitive electric switch device, part of which is visible in a cutaway portion of FIG. 1, FIG. 2 is a perspective view, partially cut away, of the position-sensitive electric switch device fitted in the wrist-watch of FIG. 1, FIG. 3 is a developed diagrammatic view of part of the device of FIG. 2 in a position corresponding to the "flat-lying" position of the wrist-watch, FIG. 4 is a sectional profile view of the device of FIG. 2 in the position shown in FIG. 3, FIG. 5 is a developed diagrammatic view analogous to FIG. 3, but with the device in a position corresponding to the "read-off" position of the watch, FIG. 6 is a sectional profile view analogous to FIG. 4, but where the device is in the position shown in FIG. 5, and further showing up to what limit of inclination the device operates to establish an electric contact, FIG. 7 is a partial vertical cross-section taken on the line VII—VII of FIG. 8 of a wrist-watch comprising another embodiment of a position-sensitive electric switch device, the wrist-watch being shown in the flat-lying position, FIG. 8 is a partial horizontal cross-section, taken along the line VIII—VIII of FIG. 7, of the wrist-watch according to FIG. 7, and FIG. 9 is a partial view similar to FIG. 7, but showing the wrist-watch in the read-off position.

FIG. 1 shows a wrist-watch 1 equipped with an electronic digital display 2, e.g., one utilizing photoluminescent diodes, and comprising an annular electric switch device 3. FIG. 1 illustrates diagrammatically how the switch device 3 is fitted in the caseband of the wrist-watch 1, but is should be noted that, in reality, the device 3 takes up less space than is shown in the cutaway portion at the "6 o'clock" position of the watch 1.

FIG. 2 shows the construction of the switch device 3 in more detail. Here it may be seen that the device 3 is chiefly composed of two annular parts 4 and 5, made of insulating material, preferably plastic, and having complementary profiles in the shapes of asymmetrical L's, so that they join to form an enclosed annular chamber or space 6. A drop of electrically conductive liquid, preferably mercury, is placed in the space 6; although that cannot be seen in FIG. 2, it is clearly visible in FIGS. 3–6. The space 6 is rectangular in profile, its long sides running axially and its short sides radially. In an embodiment reduced to practice, the cross-section of the space 6 was 4 mm. high and 1 mm. wide, and the plastic parts 4 and 5 were each 1 mm. thick, which means that the cross-section of the annular assembly forming the device 3 measured 6 × 3 mm. Two metal pins 9 and 10 pass in a fluid-tight manner through the cylindrical portion of the annular part 5 and emerge inside the space 6, one near the lower short side of the rectangle, formed by the short arm of the part 5, and the other near the upper short side of the rectangle, formed by the short arm of the part 4. The pins 9 and 10 also project outside the space 6, i.e., into the enclosure surrounded by the annular assembly 3, as may be seen in FIG. 1; this makes it possible to connect the pins 9 and 10, in a manner not shown, to electric or electronic circuitry in the watch 1. Thus, depending upon whether the pins 9 and 10 are electrically connected to or disconnected from the inside of the enclosed space 6, an electrical or electronic operation of the watch 1, generally the illumination of the display 2, can be controlled. It should be noted that any other electrical or electronic operation requiring a switch might likewise be carried out by this means; illumination of the dial of a wrist-watch of any kind, including a mechanical one, might also be controlled in this way, with the aid of appropriate means. As a variation, it would also be possible to control the display of auxiliary digital indications, e.g., the date, in a wrist-watch where the time would be indicated by conventional hands operated, for instance, by a stepping motor.

In FIGS. 3–6, it may be seen how a small amount of mercury, 11 in FIGS. 3 and 4, 11' in FIGS. 5 and 6, is variously disposed within the space 6 according to whether the annular assembly 3 is lying flat or is standing upright or at a slant, with the part containing the pins 9 and 10 situated at the bottom. Owing to the particular design of the annular enclosed space 6 and to the position of the pins 9 and 10, an electrical connection is established between the latter via the mercury 11' only when the annular assembly 3 is placed vertically or at least at a 45° angle, whereas in the "flat" position, only the pin 9 is in contact with the mercury, and the pin 10 is not. It will be obvious that if the annular assembly 3 is tilted in the other direction, so that the part containing the pins 9 and 10 is situated at the top, all the mercury will run into another part of the annular assembly 3, and neither the pin 9 nor the pin 10 will be in contact with it. According to the amount of mercury inserted in the space 6, and according to the size and shape of that space, the maximum incline where contact between the pins 9 and 10 is established or broken off will be closer to or farther from the vertical. It has been found that a maximum incline of about 45° gives good results.

It will be noted that in FIGS. 2, 3 and 4, the space 6 contains baffle elements 7 and 8 which are triangular in shape when viewed in a section taken tangent to the assembly 3. These baffle elements 7 and 8 comprise steep, flat sides 12 and 13, which "shelter" the ends of the pins 9 and 10, respectively. As shown in the drawings, the sides 12 and 13 each extend into the annular space 6 and each of said sides obturates at least one half of the cross-sectional area of said annular space. It will be easily understood that the steep sides 12 and 13 tend to brake any inopportune movements of the mercury in one direction or the other due to the forces of inertia which are produced when the wrist-watch 1, and hence the device 3, is subjected to jolts, shocks, or significant acceleration. Moreover, the two baffles or triangular projections 7 and 8 leave only a narrow passage 14 between them, just wide enough for the mercury to pass through it without being subject to capillary action, but nevertheless braking the movements of the mercury to an appreciable extent. Therefore, even if the watch is briefly and inadvertently placed in the read-off position, a fraction of a second will go by before contact is established between the pins 9 and 10. This will not at all bother a wearer who wishes to find out the time, but it will prevent unnecessary illumination of the dial if the read-off position is maintained for only a small fraction of a second. It should be noted that by selecting the appropriate dimensions for the baffle elements 7 and 8, it is possible to adjust the width of the passage 14 and hence the time-lag of the illumination. If a considerable time-lag is desired, particularly starting from the position in which the watch 1 and the switch device are laying flat, baffle elements identical to elements 7 and 8 may be further disposed all along the whole annular space 6, thus making it possible to obtain a delay in illumination of 1 second or more, as the case may be. Such a "multi-baffle-element arrangement" will be further described in conjunction with FIGS. 7–9, which show another embodiment of the invention.

In FIGS. 4 and 6, a dash-line 15 indicates the surface level of the mercury in the respective positions illustrated.

The construction of the annular assembly 3 is extremely simple. The baffle element 7, as well as other identical baffle elements, if any, is made in one piece with the annular plastic part 4, which may easily be molded; the same applies to baffle element 8 and annular part 5, respectively. Once the parts 4 and 5 are assembled, they are cemented or welded by any method applicable to the insulating material of which they are made, one of the pins 9 and 10 is sealed in place, e.g., by forcing it into a small hole provided for that purpose, then the desired amount of mercury is inserted in the space 6 through the small hole provided for the other of the pins 9 or 10. The mercury may be inserted by means of a syringe, and once it is the space 6, the second pin 9 or 10 is sealed in place, cemented if necessary, and the device is complete. All that remains is to fit it in the sidewall of a watch-case, which may be a conventional one just as well a an encapsulted movement to which a caseband provided with horns for attaching the watch-bracelet is subsequently to be fitted.

Tests carried out with a device analogous to that shown in FIG. 2, and having the aforementioned dimensions, have demonstrated that no unintentional or random contact was established while the watch was being worn, under the most diversified conditions; moreover, contact was established only in vertical position or in inclined positions of about 45° or more to the horizontal.

A number of design variations are conceivable which might be produced within the framework of the present invention, in which baffle elements are utilized to prevent random operation by inertia of a liquid-conductor electric switch contact.

One such variation is shown in FIGS. 7–9, for example; it consists in making the enclosure assembly, which forms and defines an annular enclosed space 26, directly in a wall or caseband 24 of a watch-case 21. A U-shaped annular recess 26 might easily be contrived for that purpose in an inner cylindrical face 22 of the caseband or sidewall 24, a simple ring 25 of insulating material then being used to close off the space inside the groove 26. The caseband or sidewall having the groove is advantageously made of metal, and it might thus constitute one of the two contacts of the switch, the other consisting, for instance, of a single metal pin 29 passing through the ring 25 of insulating material closing off the inner space 26. In this case, since there is only one pin 29 projecting into the enclosed space at a precise location, baffle elements 27, analogous or similar to the elements 7 and 8 of the embodiment described earlier, are advantageously placed on each side of the location where the metal pin 29 emerges. As shown in FIG. 8, additional baffle elements 28 may be provided for further braking the movement of the mercury (or other conductive liquid) in the recess 26. FIG. 7 shows the wrist-watch in the flat-lying position, and it will be seen that the mercury 31 does not contact the pin 29. FIG. 9 shows the wrist-watch in the read-off position, and it will be seen that the mercury 31, contacts the pin 29, thus establishing electrical conduction between that pin and the case-band 24 (ground potential).

In the case of a caseband or capsule sidewall made of insulating material, two metal pins disposed like the pins 9 and 10 shown in the drawing might obviously be provided.

In order to define more precisely, or asymmetrically with respect to the vertical, the inclined positions in which the electric switch establishes contact, it would likewise be possible to dispose the annular enclosure assembly at a slight angle to the watch-case or capsule, provided the latter were thick enough, of course. The annular assembly might also take the shape of a ring which is out of true, analogous to that of a buckled wheel, in order to obtain certain particular operating characteristics. Another assembly which has been tried out comprises two parallel annular enclosed spaces disposed side by side in the axial direction and intercommunicating only at certain points of the annular shape. The two pins forming the contact elements are disposed in each of the two enclosed spaces, respectively, at or near the location of an intercommunication opening between the two parallel spaces. This has made it possible especially to obtain relatively long time-lags before illumination. Another possibility would be to give the cross-sectional profile of the enclosed space the shape of a parallelogram or trapezoid rather than a rectangle. The two electrical connection pins might also be disposed on the same level (as compared with what is shown in FIGS. 3 and 4). It would likewise be conceivable to use a simple tube of plastic material with its two ends joined in the manner of an inner tube; the baffle elements could then be inserted in it beforehand, when it is still straight and has not yet been bent closed. A connecting pin previously introduced laterally might serve as a stop for the baffle element when it is inserted, whereupon the second connecting pin would be introduced in the same way.

Finally, an embodiment may be mentioned which is quite different but still comes within the framework of the present invention, and which has also been the subject of conclusive tests in an existing type of wrist-watch. In certain types of watches, as a matter of fact, the modular design of the circuit elements of an electronic watch leaves an empty space approximately in the shape of a 90° sector centered approximately at the "3 o-clock" position. For this type of wrist-watch, a switch according to the concept in question has been produced, but one in which the enclosed space is in the shape of a sector rather than annular so that it can be mounted in the aforementioned empty space. One of the angles of this sector, between a straight radial side and a cylindrically curved surface, points downward when the watch is held vertically or at an angle to the "9 o'clock" horizontal axis. Disposed in this dihedral angle, approximately along its bisector, is a small plate forming a screen, and on each side of the screen there is a contact element. These two contact elements play the same part as the pins 9 and 10 in the embodiment shown in the drawing, and like those pins, they are situated at different heights. The volume of mercury introduced into the enclosed space is just enough to cover the top of the screen when the watch is in the read-off position, while in the other positions, the mercury is either divided into two parts having no contact with each other or is entirely on one side of the screen (which is naturally made of an insulating material) or, when the watch is lying flat, is evenly distributed over the bottom of the sector-shaped enclosed space so that, because the contact elements are at different heights, the mercury touches only one of them.

The foregoing embodiment has also proved satisfactory, the screen preventing inopportune random contacts produced by inertia when jolts, shocks, or acceleration occur. An annular embodiment, on the other hand, such as the one shown in the drawing, gives a better performance if an illumination time-lag of a predetermined duration is desired. The various examples of variations in construction which have just been described by way of a complement to what is illustrated in FIGS. 1–9 clearly demonstrate that the concept according to the present invention makes possible a large number of designs in various shapes and with various arrangements. On the other hand, the annular configuration with baffle elements of a ski-jump shape, as illustrated in the drawing, is preferred for its simplicity, its low cost, and its particularly favorable performance.

What is claimed is:

1. An electric switch device for wrist-watches equipped with electric or electronic members and having a case with a sidewall, comprising:

an enclosure assembly having at least one component adapted to be secured in a said wrist-watch, said assembly defining an annular enclosed chamber of a predetermined volume, and an electricaly conductive liquid confined within said enclosed chamber and having a volume less than said predetermined volume of said chamber, said assembly comprising two annular electrically insulating parts having complementary L-shaped profiles for forming said annular enclosed chamber when joined, at least one of said insulating parts having an annular shape enabling it to be secured in said sidewall, and said assembly further comprising two electrically conductive parts, said electrically conductive parts being structurally spaced from one another and each being exposed outside said enclosed annular chamber for connection to said electric or electronic members, and inside said enclosed chamber adapted to be selectively either electrically connected to one another via said liquid or left electrically separated from one another in response to movements of said liquid within said annular chamber depending upon various positions assumed by said assembly, at least one of said conductive parts comprising a portion made of electrically conductive material accommodated in one of said insulating parts and exposed within said annular chamber only at a predetermined location thereof where it is delimited by a curved surface, said switch device further comprising at least one baffle element disposed in said enclosed chamber in proximity to said predetermined location for preventing said liquid from coming in contact by simple inertia with said portion made of electrically conductive material when said assembly is subjected to jolts.

2. A switch device according to claim 1, wherein said two electrically conductive parts are two metal pins passing through a said insulating part and emerging in said annular enclosed space at two neighboring locations.

3. A switch device according to claim 2, wherein said at least one baffle element is disposed between said two neighboring locations.

4. A switch device according to claim 2, wherein said L-shaped profiles are asymmetrical, and said annular enclosed chamber has an axially elongated rectangular cross-section.

5. A switch device according to claim 4, wherein said two neighboring locations are situated at different levels of a long side of said rectangular cross-section and at different positions along the length of said annular enclosed chamber.

6. A switch device according to claim 4, wherein each said baffle element is a projection comprising an inclined plane, being integral with a said annular insulating part, rising to almost the full height of said enclosed chamber, and occupying the full width of said enclosed chamber.

7. A switch device according to claim 6, comprising two said baffle elements disposed between said two neighboring locations, wherein said two baffle elements are opposite and inverted in relation to one another so as to leave between them only a narrow sloping passage and to exhibit two steep sides situated at least approximately in a plane of said rectangular cross-section, said two pins respectively emerging in said enclosed chamber in the immediate vicinity of and facing said two steep sides.

8. An electric switch device for wrist-watches equipped with electric or electronic members and having a case with a sidewall, said switch device comprising an enclosure assembly including means defining an annular enclosed chamber of predetermined volume, an electrically conductive liquid confined within said annular chamber and having a volume less than said predetermined volume, two electrically conductive elements, insulating means for supporting said conductive elements in electrically spaced relation to one another adjacent said chamber, said two conductive elements having portions exposed outside said annular chamber for connection to said electric or electronic members, and said two conductive elements having further portions exposed inside said enclosed chamber and adapted to be selectively electrically connected to one another via said liquid or adapted to be left electrically separated from one another in response to movements of said liquid within said annular chamber depending upon various positions assumed by said assembly, the further portion of at least one of said conductive elements being exposed within said annular chamber only at a predetermined location thereof, and at least one baffle element disposed within said annular chamber in proximity to said predetermined location for preventing said liquid from coming into contact with said further portion of said conductive element due to simple inertia when said assembly is subjected to jolts, said baffle being shaped to define a flat surface which extends partially across the interior of said annular chamber in a direction transverse to the direction of elongation of said annular chamber at a position closely adjacent to but spaced from said further portion of said conductive element.

9. The switch device of claim 8 wherein said flat surface extends across the interior of said annular chamber to an extent sufficient to obturate at least half the cross-sectional area of said annular chamber.

10. A switch device according to claim 9 wherein a plurality of said baffle elements, each having a flat surface extending partially across the interior of said annular chamber to an extent sufficient to obturate at least half the cross-sectional area of said chamber, are disposed in spaced relation to one another along said annular enclosed chamber for slowing the flow of said liquid in the direction of elongtion of said annular chamber.

11. A switch device according to claim 9 wherein said annular chamber is defined partly by an annular recess in said sidewall of said case and partly by a further component positioned to close off said annular recess.

12. A switch device according to claim 11 wherein said sidewall is made of metal and constitutes one of said two electrically conductive elements, said further component is made of insulating material and constitutes said insulating means, and the other of said two electrically conductive elements passes through said further component and is exposed within said chamber at said predetermined location.

* * * * *